US008139790B2

(12) United States Patent
Wu

(10) Patent No.: US 8,139,790 B2
(45) Date of Patent: Mar. 20, 2012

(54) INTEGRATED CIRCUIT BIASING A MICROPHONE

(75) Inventor: Li-Te Wu, Taipei (TW)

(73) Assignee: Fortemedia, Inc., Sunnyvale, CA (US)

( * ) Notice: Subject to any disclaimer, the term of this patent is extended or adjusted under 35 U.S.C. 154(b) by 979 days.

(21) Appl. No.: 12/121,131

(22) Filed: May 15, 2008

(65) Prior Publication Data

US 2009/0285412 A1 Nov. 19, 2009

(51) Int. Cl.
*H04R 3/00* (2006.01)

(52) U.S. Cl. ..... 381/111; 381/112; 381/113; 381/114; 381/115; 381/120; 381/91; 381/122

(58) Field of Classification Search ..... 381/111, 381/112, 113, 114, 115, 120, 91, 122
See application file for complete search history.

(56) References Cited

U.S. PATENT DOCUMENTS

| | | | | |
|---|---|---|---|---|
| 7,110,560 | B2 * | 9/2006 | Stenberg | 381/113 |
| 2002/0094091 | A1 * | 7/2002 | Wu et al. | 381/58 |
| 2008/0310655 | A1 * | 12/2008 | Holzmann | 381/122 |

* cited by examiner

*Primary Examiner* — Kimberly Nguyen
*Assistant Examiner* — Mohammad T Karimy
(74) *Attorney, Agent, or Firm* — Thomas|Kayden

(57) ABSTRACT

The invention provides an integrated circuit. The integrated circuit receives a first signal from a microphone via a first node. In one embodiment, the integrated circuit comprises a biasing circuit and a buffering circuit. The biasing circuit is coupled between the first node and a second node, drives the microphone with a first voltage source, and filters the first signal to generate a second signal at the second node. In one embodiment, the biasing circuit comprises a first resistor, a first capacitor, and a load element. The first resistor is coupled between the first voltage source and the first node. The first capacitor is coupled between the first node and the second node. The load element is coupled between the second node and a second voltage source. The buffering circuit is coupled between the second node and a third node and buffers the second signal to generate a third signal at the third node.

8 Claims, 7 Drawing Sheets

INTEGRATED CIRCUIT BIASING A MICROPHONE

BACKGROUND OF THE INVENTION

1. Field of the Invention

The invention relates to microphones, and more particularly to biasing circuits of microphones.

2. Description of the Related Art

Referring to FIG. 1A, a block diagram of a conventional microphone circuit 100 is shown. The conventional microphone circuit 100 comprises a microphone 102, a biasing circuit 104, and an integrated circuit 110. The microphone 102 is an electret condenser microphone (ECM) and comprises a transducer 112, a capacitor 114, and a transistor 116. When a sound pressure propagates to a diaphragm of the microphone 100, the diaphragm vibrates with the sound pressure, and a distance between the diaphragm and a back plate of the microphone 100 changes with the sound pressure. The diaphragm and the back plate forms the capacitor 114 with a capacitance changing with the distance between the back plate and the diaphragm, thereby converting the sound pressure to a voltage signal as an output of the microphone 102 at a node 152.

Because the microphone 102 requires external driving power to drive its operation, the biasing circuit 104 provides the microphone with a voltage source $V_A$. The biasing circuit 104 comprises a resistor 122 and a capacitor 124. The resistor 122 is coupled between the voltage source $V_A$ and the node 152. The resistance of the resistor 122 ranges between 2.2 kΩ and 3.3 kΩ. The capacitor 124 isolates a DC bias voltage at the node 152 from a DC bias voltage at the node 154, passing only the AC portion of the voltage signal to the node 154.

The transistor 116 and the resistor 122 forms a first gain stage amplifying the voltage signal at the gate of the transistor 116 to obtain a voltage signal at the node 152. The voltage gain $G_1$ of the first gain stage is determined according to the following algorithm:

$$G_1 = g_m \times (R_{122} \| R_{132}); \quad (1)$$

wherein $g_m$ is the transconductance between the gate and the drain of the transistor 116, $R_{122}$ is the resistance of the resistor 122, and $R_{132}$ is the resistance of a resistor 132. An ordinary value of the voltage gain $G_1$ is 1.

The integrated circuit 110 comprises a pre-amplifier circuit 106 and an analog-to-digital converter 108. The pre-amplifier circuit 106 comprises two resistors 132 and 134 and an operational amplifier 136. The pre-amplifier 106 forms a second gain stage amplifying the voltage signal at the node 154 to obtain a voltage signal at the node 156. The input resistor 132 is coupled between the node 154 and a negative input terminal of the operational amplifier 136. The feedback resistor 134 is coupled between the negative input terminal and an output terminal of the operational amplifier 136. The positive input terminal of the operational amplifier 136 is coupled to a voltage source $V_B$. The gain $G_2$ of the pre-amplifier circuit 106 is determined according to the following algorithm:

$$G_2 = \frac{R_{fb}}{R_{in}}; \quad (2)$$

wherein $R_{fb}$ is the resistance of the feedback resistor 134, and $R_{in}$ is the resistance of the input resistor 132. The analog-to-digital converter 108 then converts the amplified voltage signal at node 156 from analog to digital for further digital processing.

The input resistor 132 and the capacitor 124 forms a high pass filter. Referring to FIG. 1B, a Bode plot of the high pass filter comprising the capacitor 124 and the resistor 132 is shown. The cutoff frequency $F_{3dB}$ of the high pass filter is determined according to the following algorithm:

$$F_{3dB} = \frac{1}{2\pi \times R_{132} \times C_{124}}; \quad (3)$$

wherein $R_{132}$ is the resistance of the resistor 132, and $C_{124}$ is the capacitance of the capacitor 124. Because human ears can hear sound with frequencies higher than 20 Hz, the cutoff frequency $F_{3dB}$ must be greater than 20 Hz to prevent a filtered signal from improper signal attenuation.

An ordinary resistance $R_{132}$ of the input resistor 132 ranges from 10 kΩ to 50 kΩ. To keep the cutoff frequency $F_{3dB}$ greater than 20 Hz, the capacitance $C_{124}$ of the capacitor 124 must therefore be greater than 0.1 μF according to the algorithm (3). Because a conventional semiconductor manufacturing process can only form a capacitor with a capacitance ranging from 1 fF to 100 pF in an integrated circuit, the capacitor 124 with a capacitance greater than 0.1 μF therefore cannot be merged into the integrated circuit 110. Thus, the biasing circuit 104 is formed on a printed circuit board and occupies a large layout space. Because portable devices such as cell phones have limited sizes to accommodate circuit components thereof, a microphone circuit 100 with a large layout space, however, cannot meet the size requirements of portable devices. Thus, a microphone circuit with a smaller size is required.

BRIEF SUMMARY OF THE INVENTION

The invention provides an integrated circuit. The integrated circuit receives a first signal from a microphone via a first node. In one embodiment, the integrated circuit comprises a biasing circuit and a buffering circuit. The biasing circuit is coupled between the first node and a second node, drives the microphone with a first voltage source, and filters the first signal to generate a second signal at the second node. In one embodiment, the biasing circuit comprises a first resistor, a first capacitor, and a load element. The first resistor is coupled between the first voltage source and the first node. The first capacitor is coupled between the first node and the second node. The load element is coupled between the second node and a second voltage source. The buffering circuit is coupled between the second node and a third node and buffers the second signal to generate a third signal at the third node.

The invention also provides another integrated circuit. The integrated circuit receives a first signal and a first opposite signal from a microphone via a first node and a first opposite node. In one embodiment, the integrated circuit comprises a biasing circuit and a buffering circuit. The biasing circuit is coupled between the first node, the first opposite node, a second node, and a second opposite node, biases the microphone with a first voltage source and a second voltage source, filters the first signal to generate a second signal at the second node, and filters the first opposite signal to generate a second opposite signal at the second opposite node. In one embodiment, the biasing circuit comprises a first resistor, a first capacitor, a first load element, a second resistor, a second capacitor, and a second load element. The first resistor is coupled between the first voltage source and the first node. The first capacitor is coupled between the first node and the second node. The first load element is coupled between the second node and a third voltage source. The second resistor is coupled between the first opposite voltage source and the first opposite node. The second capacitor is coupled between the first opposite node and the second opposite node. The second load element is coupled between the second opposite node and the third voltage source. The buffering circuit is coupled between the second node, the second opposite node, a third node, and a third opposite node, buffers the second signal to generate a third signal at the third node, and buffers the second opposite signal to generate a third opposite signal at the third opposite node.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
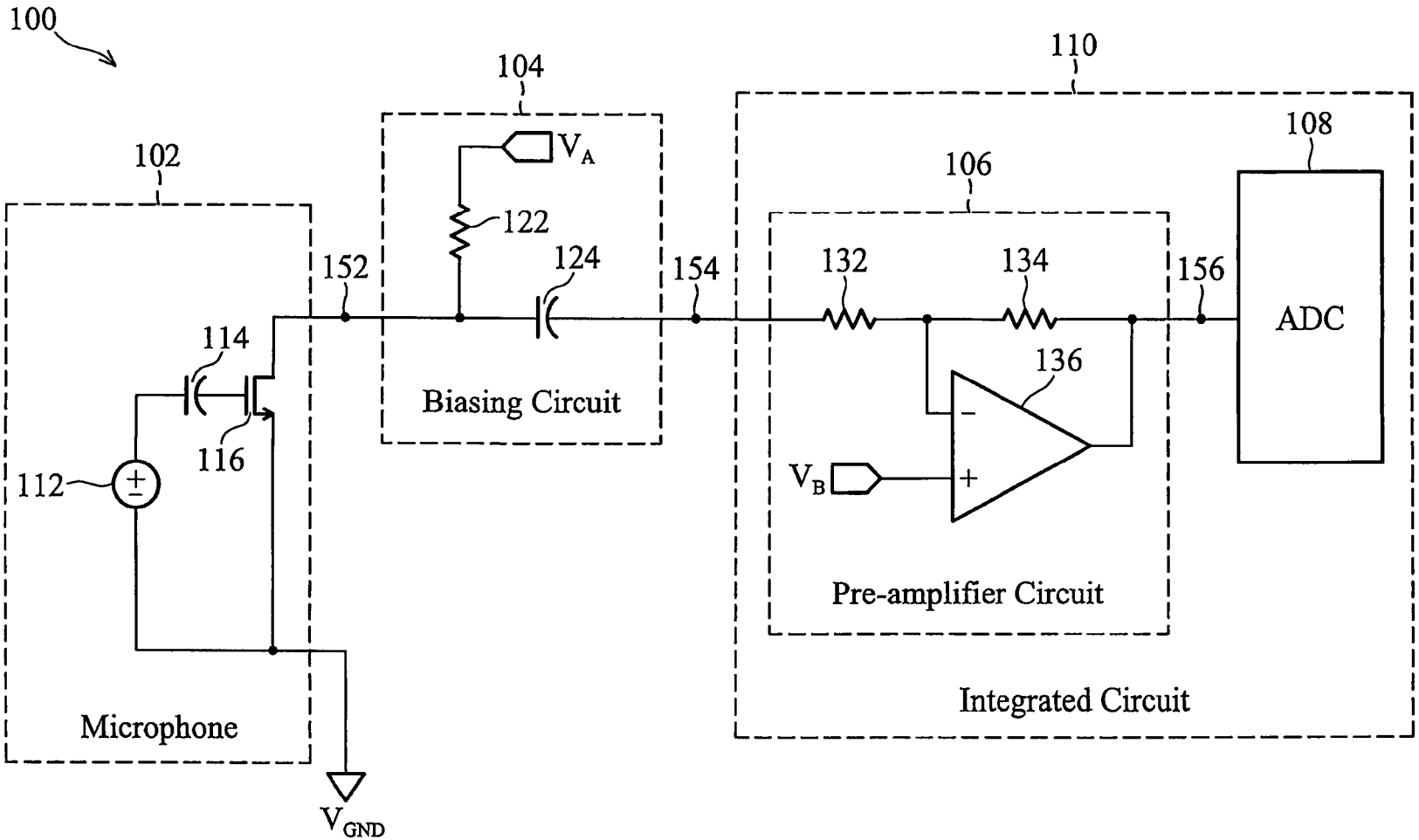
FIG. 1A ( PRIOR ART )
FIG. 1A is a block diagram of a conventional microphone circuit.
Figure 1B:
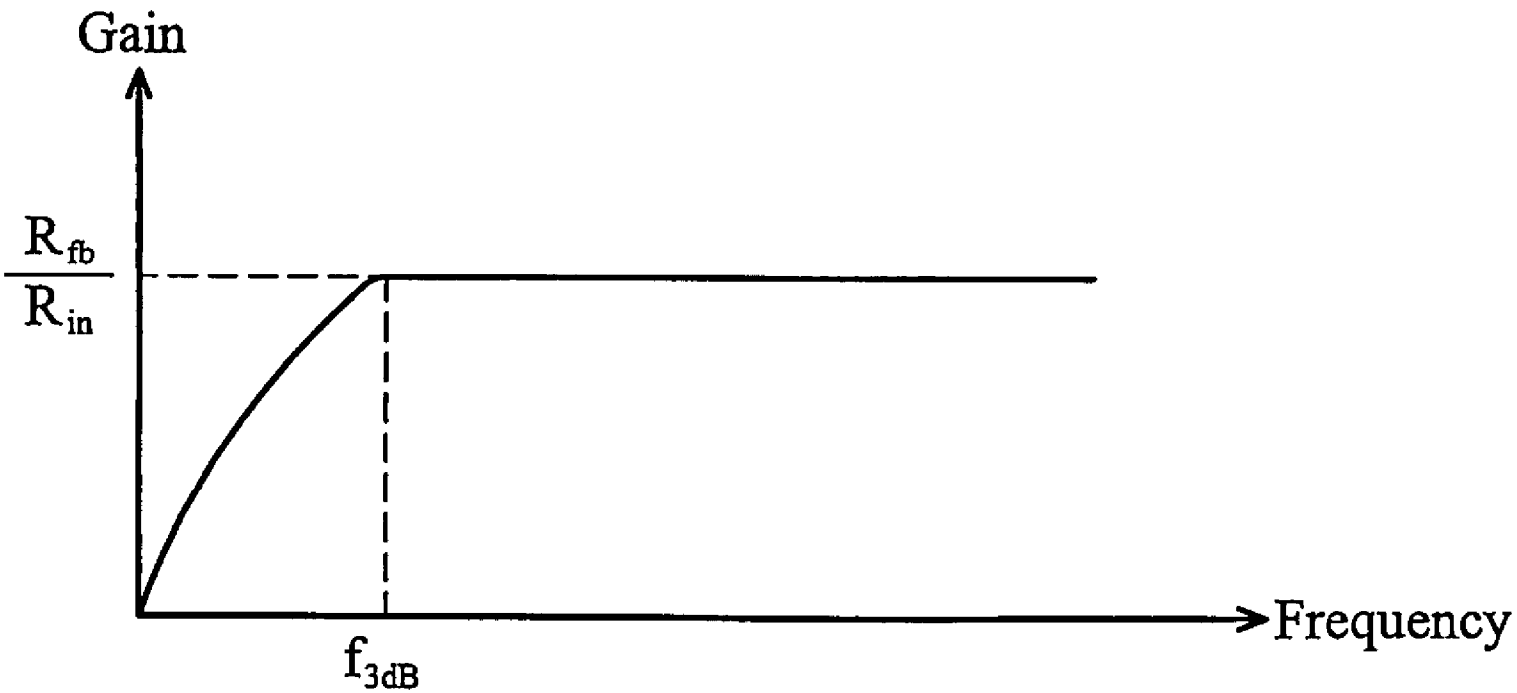
FIG. 1B ( PRIOR ART )
FIG. 1B is a Bode plot of the high pass filter comprising the capacitor 124 and the resistor 132 of the biasing circuit of FIG. 1A.
Figure 2A:
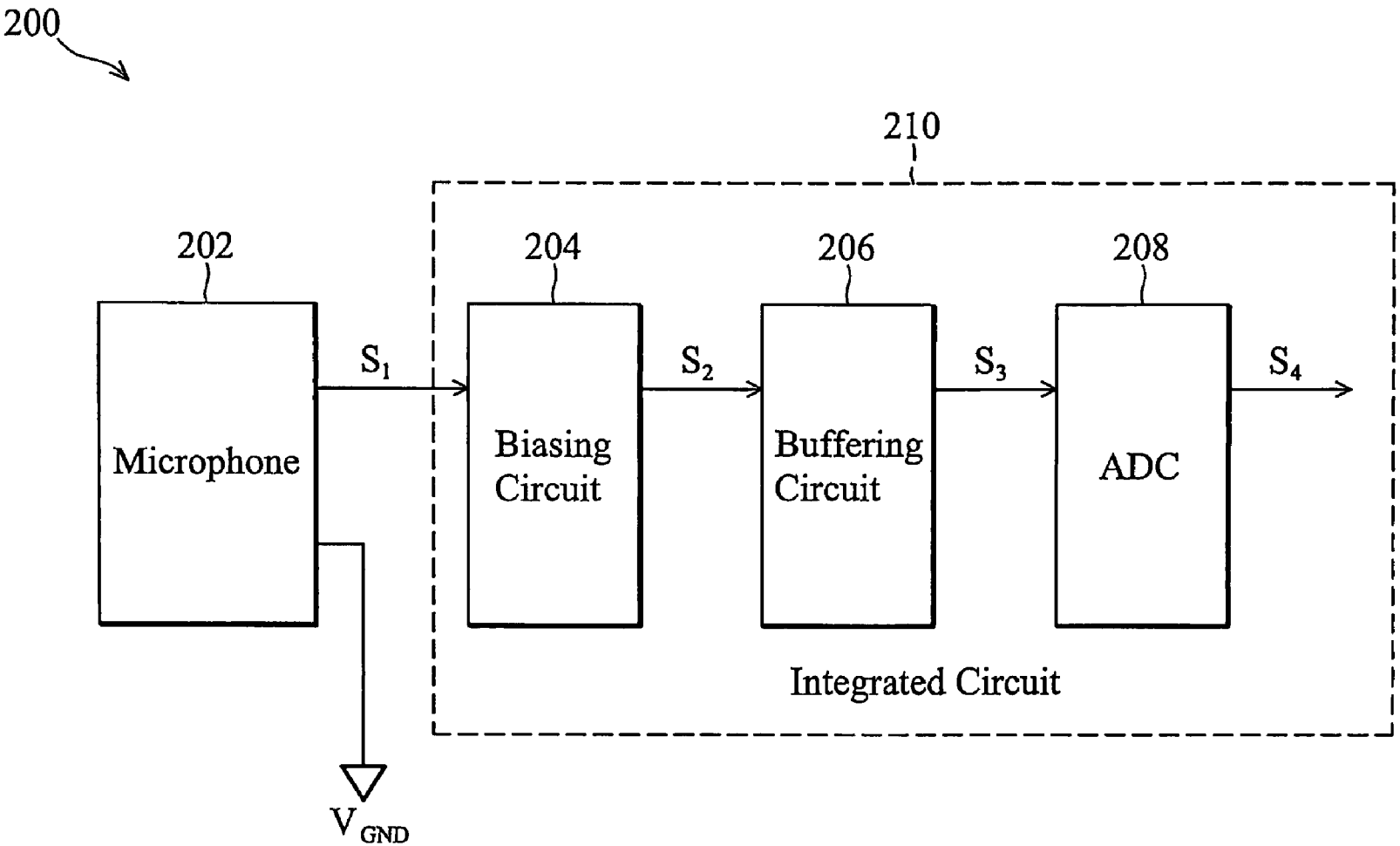
FIG. 2A is a block diagram of a microphone circuit according to the invention.

Referring to FIG. 2A, a block diagram of a microphone circuit 200 according to the invention is shown. The microphone circuit 200 comprises a microphone 202 and an integrated circuit 210. The microphone 202 converts a sound pressure to a voltage signal $S_1$. The integrated circuit 210 comprises a biasing circuit 204, a buffering circuit 206, and an analog-to-digital converter 208. Because the microphone 202 requires an external power source, the biasing circuit 204 provides a voltage source to bias the microphone 202. In addition, the biasing circuit 204 filters the voltage signal $S_1$ to generate a voltage signal $S_2$. The buffering circuit 206 then buffers the voltage signal $S_2$ to generate a voltage signal $S_3$. Finally, the analog-to-digital converter 208 converts the signal $S_3$ from analog to digital to obtain a signal $S_4$ for further digital processing. Unlike the biasing circuit 104 being separated from the integrated circuit 110, the biasing circuit 204 is merged into the integrated circuit 210 with a small size. The microphone circuit 200 therefore meets the size requirement of circuit components of portable devices such as cell phones.

Figure 2B:
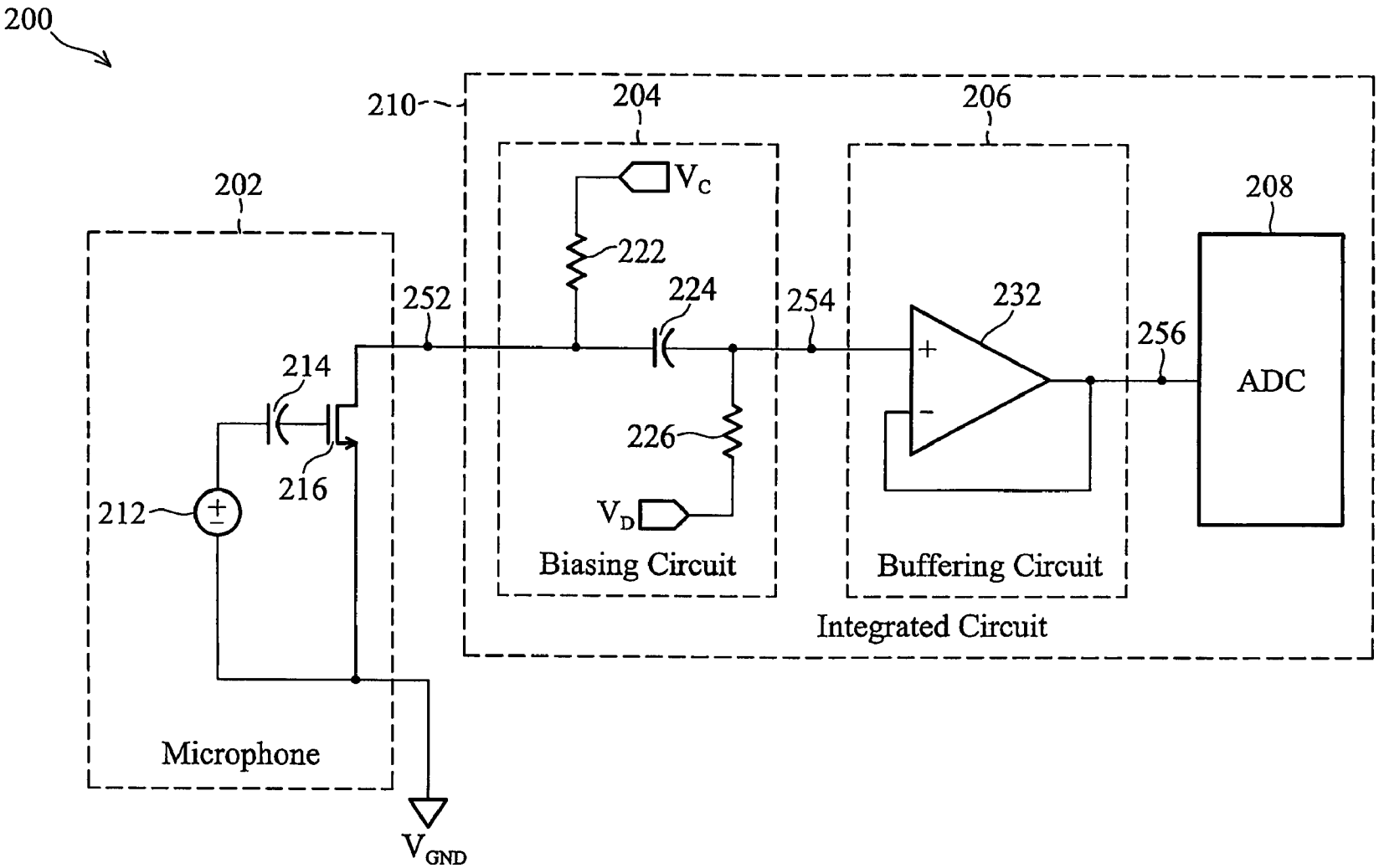
FIG. 2B is a detailed circuit diagram of the microphone circuit of FIG. 2A according to the invention.

Referring to FIG. 2B, a detailed circuit diagram of the microphone circuit 200 of FIG. 2A according to the invention is shown. The microphone 202 is an electret condenser microphone (ECM). The microphone 202 has the same circuit configuration as that of the microphone 102 and comprises a transducer 212, a conductor 214, and a transistor 216. The biasing circuit 204 is coupled to the microphone via a node 252 and comprises two resistors 222 and 226 and a capacitor 224. The resistor 222 is coupled between the node 252 and a voltage source $V_C$. The capacitor 224 is coupled between the node 252 and a node 254. The capacitor 224 isolates the DC biasing voltage at the node 252 from the DC biasing voltage at the node 254, passing only an AC portion of the voltage signal at the node 252 to the node 254. The resistor 226 is coupled between the node 254 and a voltage source $V_D$. In one embodiment, the voltage source $V_C$ has a voltage of 2V, and the voltage source $V_D$ has a voltage of 0.3V.

The resistor 222 has a resistance ranges from 2.2 kΩ to 4.7 kΩ. The capacitor 224 has a capacitance ranging from 100 fF to 100 pF. Because the capacitor 224 has a capacitance which can be fabricated with a semiconductor manufacturing process, the biasing circuit is merged into the integrated circuit 210. The resistor 226 has a resistance greater than 1 MΩ, which is much higher than the resistance of the resistor 222. Thus, the voltage $V_{254}$ at the node 254 is determined according to the following algorithm:

$$V_{254} = V_{252} \times (g_m R_{222}) \times \left[\frac{sC_{224}R_{226}}{1 + sC_{224}R_{226}}\right] + V_D\left[\frac{1 + sC_{224}R_{222}}{1 + sC_{224}R_{226}}\right]; \quad (4)$$

wherein $V_{252}$ is the voltage at the node 252, $g_m$ is a transconductance between the gate and the drain of the transistor 216, $R_{222}$ is the resistance of the resistor 222, $C_{224}$ is the capacitance of the capacitor 224, $R_{226}$ is the resistance of the resistor 226, and s is an angular frequency parameter. According to algorithm (4), the output voltage $V_{254}$ of the biasing circuit 204 has a cut-off frequency of $$\frac{1}{2\pi C_{224}R_{226}}.$$

When a frequency is lower than the cut-off frequency, the output voltage $V_{254}$ can be determined according to the following algorithm and has a DC value approximate to the voltage source $V_D$:

$$V_{254} \cong V_{252} \times (g_m R_{222}) \times (sC_{224}R_{226}) + V_D; \quad (5)$$

In addition, when a frequency is greater than the cut-off frequency, the output voltage $V_{254}$ can be determined according to the following algorithm and has an AC gain approximate to $(g_m \times R_{222})$:

$$V_{254} \cong V_{252}(g_m R_{222}) + V_D \times \frac{R_{222}}{R_{226}}. \quad (6)$$

The biasing circuit 204 therefore forms a high pass filter filtering the voltage signal at the node 252 with a cut-off frequency of $$\frac{1}{2\pi C_{224} R_{226}}$$

to generate the voltage signal at node 254. Because human ears can hear audio signals with frequencies higher than 20 Hz, the cut-off frequency must be greater than 20 Hz to ensure that all frequency components with a frequency higher than 20 Hz are not attenuated. Because the capacitor 224 has a small capacitance ranging between 1 fF to 100 pF, the resistor 226 therefore must have a resistance greater than 1 MΩ. For example, when the capacitor 224 has a capacitance of 5 pF, the resistor 226 must have a resistance greater than 1.6 GΩ(=1/[2×π×5 pF×20 Hz]).

A conventional semiconductor manufacturing process can only form a resistor with resistance ranging from 1Ω to 1 MΩ in an integrated circuit. A resistor with a resistance higher than 1 MΩ, however, is hard to implement in an integrated circuit. The resistor 226 therefore is implemented with diodes or transistors. Referring to FIG. 3A, an embodiment of a load element 320 with a high resistance to implement the resistor 226 of FIG. 2 is shown. The load element 320 comprises two diodes 322 and 324 coupled between the output node 254 of the biasing circuit 204 and the voltage source $V_D$ in inverse direction. The voltage difference between the node 254 and the voltage source is less than 0.3V to turn off both the diodes 322 and 324.

Figure 3B:
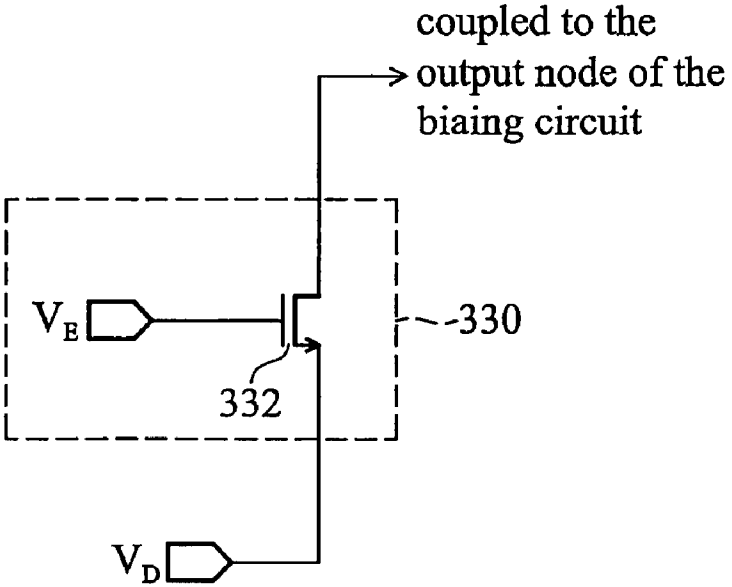
FIG. 3B shows another embodiment of a load element 330 with a high resistance to implement the resistor 226 of FIG. 2.
Figure 3A:
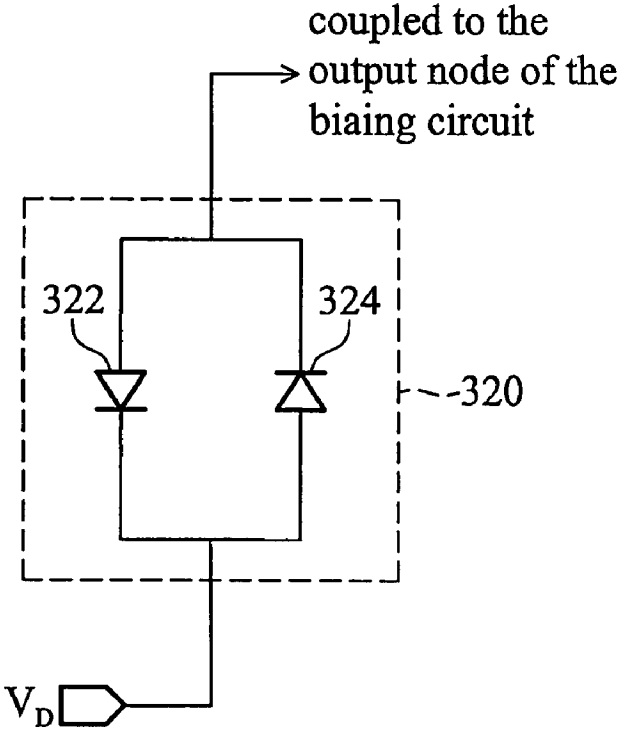
FIG. 3A shows an embodiment of a load element with a high resistance to implement the resistor 226 of FIG. 2.

Referring to FIG. 3B, another embodiment of a load element 330 with a high resistance to implement the resistor 226 of FIG. 2 is shown. The load element 330 comprises a transistor 332 coupled between the output node 254 of the biasing circuit 204 and the voltage source $V_D$. In addition, the transistor 332 has a gate coupled to a voltage source $V_E$. The difference between the voltages of the voltage source $V_E$ and the voltage source $V_D$ is not greater than a threshold voltage of the transistor 332 by 0.7V. The transistor 332 is therefore biased in a weak inversion region and has a resistance greater than 1 MΩ between its drain and its source.

Referring back to FIG. 2B. After the biasing circuit generates a voltage signal at the node 254, the buffering circuit 206 buffers the voltage signal at node 254 to generate a voltage signal at a node 256. The buffering circuit 206 comprises an operational amplifier 232 having a positive input terminal coupled to the node 254, a negative input terminal coupled to the node 256, and an output terminal coupled to the node 256. The analog-to-digital converter 208 then converts the voltage signal at the node 256 from analog to digital for further digital processing.

Figure 4A:
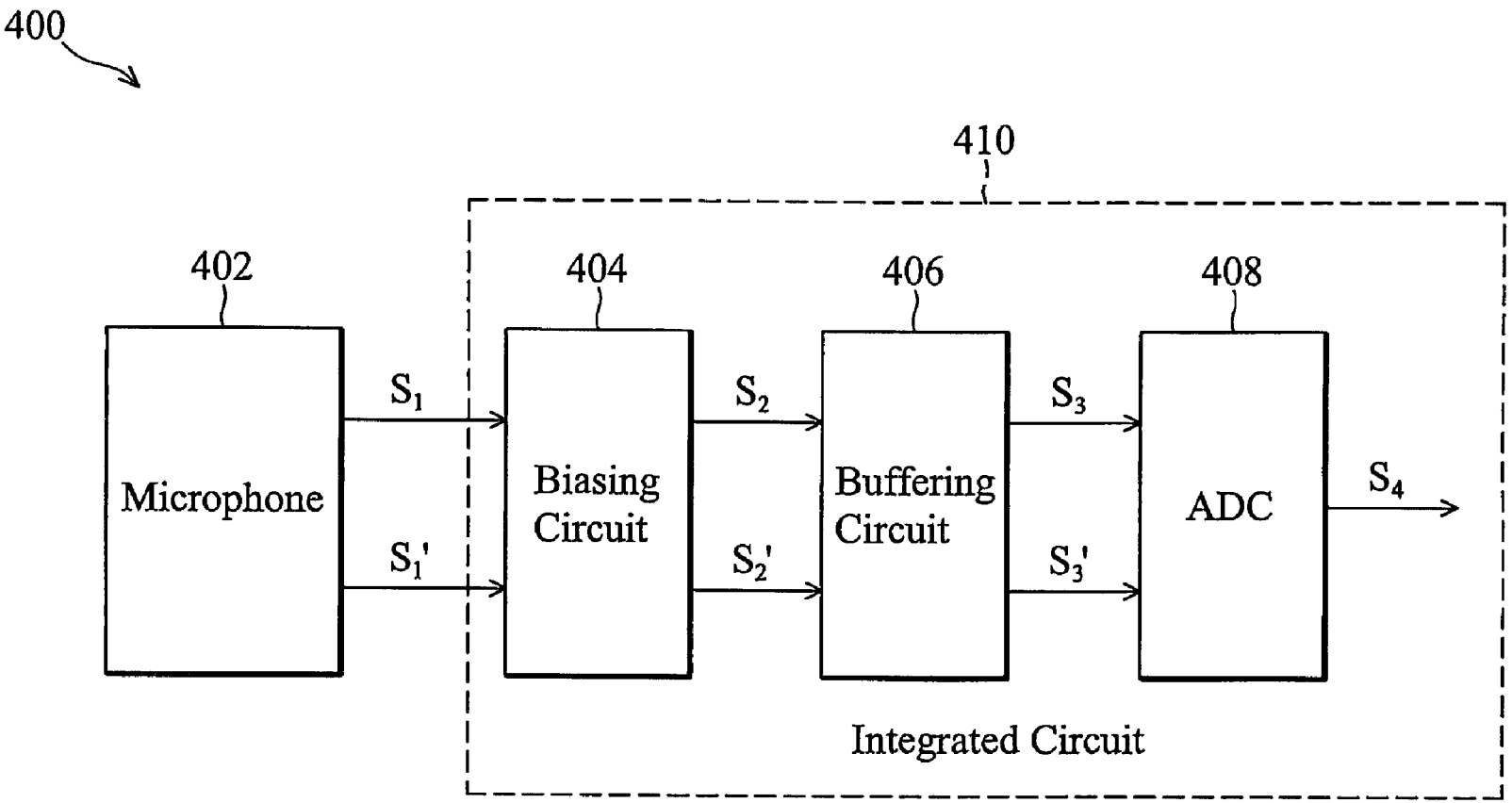
FIG. 4A is a block diagram of a microphone circuit with a differential input configuration according to the invention.

The microphone 202 of FIGS. 2A and 2B has two terminals, wherein one terminal is coupled to a ground voltage $V_{GND}$, and the other terminal is coupled to the integrated circuit 210. In another embodiment, both the two terminals of the microphone can also be directly coupled to the integrated circuit, referred to as a differential input configuration. Referring to FIG. 4A, a block diagram of a microphone circuit 400 with a differential input configuration according to the invention is shown. The microphone circuit 400 comprises a microphone 402 and an integrated circuit 410. The microphone 402 generates two signals $S_1$ and $S_1'$ changing voltage levels in opposite directions.

The integrated circuit 410 comprises a biasing circuit 404, a buffering circuit 406, and an analog-to-digital converter 408. The biasing circuit 404 biases the microphone 402 with voltage sources, filters the signal $S_1$ to generate a signal $S_2$, and filters the signal $S_1'$ to generate a signal $S_2'$. The buffering circuit 406 then buffers the signal $S_2$ to generate a signal $S_3$, and buffers the signal $S_2'$ to generate a signal $S_3'$. The analog-to-digital converter 408 then converts a difference signal between the signal $S_3$ and the signal $S_3'$ from analog to digital to obtain a signal $S_4$ for further digital processing.

Figure 4B:
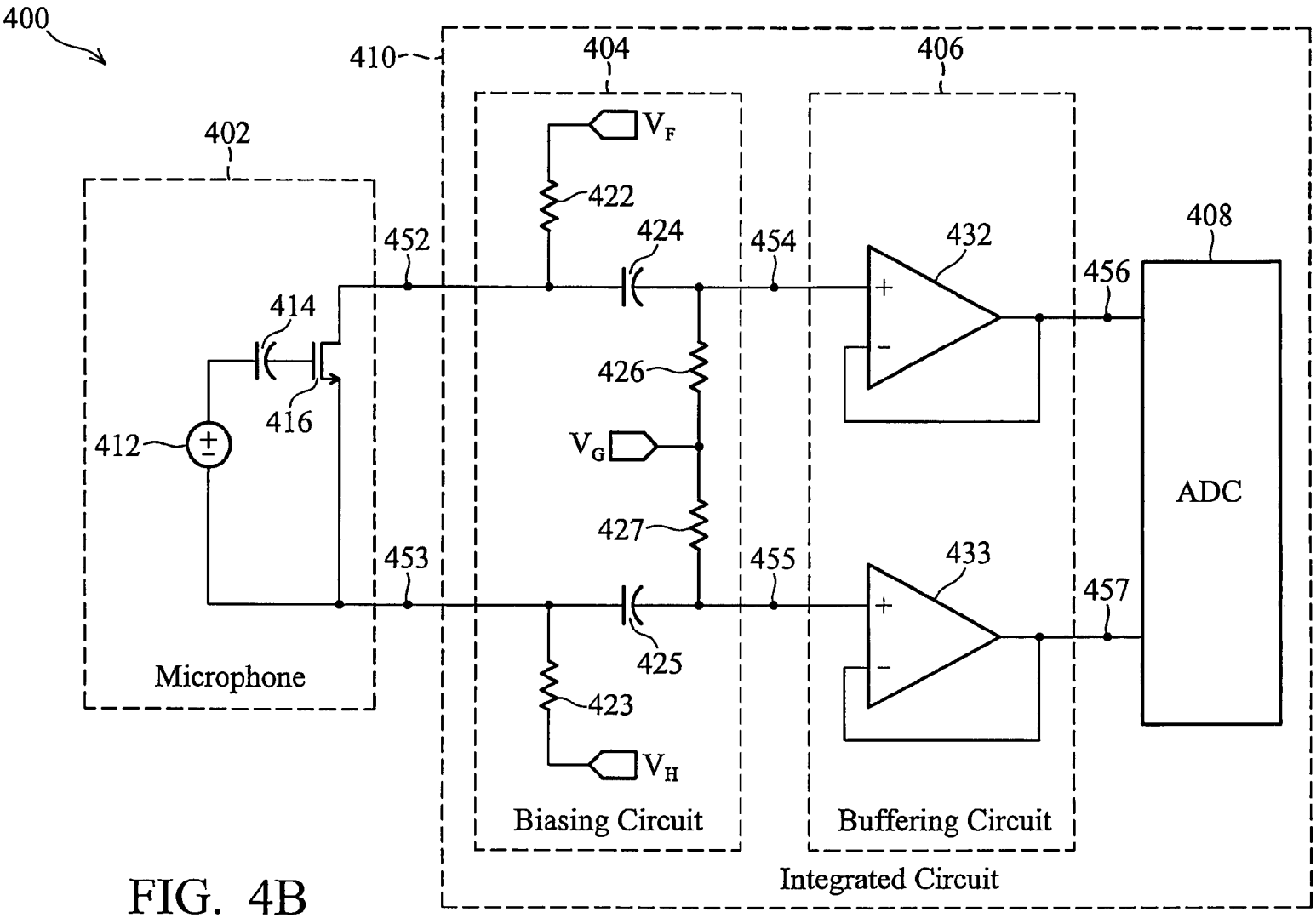
FIG. 4B is a detailed circuit diagram of the microphone circuit of FIG. 4A according to the invention.

Referring to FIG. 4B, a detailed circuit diagram of the microphone circuit 400 of FIG. 4A according to the invention is shown. Each circuit component of the integrated circuit 410 has a similar circuit structure as that of the integrated circuit 210 of FIG. 2B. The biasing circuit 404 comprises resistors 422, 423, 426, and 427 and capacitors 424 and 425. The resistors 422 and 423 are similar to the resistor 222 of FIG. 2, wherein the resistor 422 is coupled between a voltage source $V_F$ and the node 452, and the resistor 423 is coupled between a voltage source $V_H$ and the node 453. In one embodiment, the resistors 422 and 423 have a resistance of 2.2 kΩ, the voltage source $V_F$ has a voltage level of 2V~10V, and the voltage source $V_H$ has a voltage level of 0V.

The capacitors 424 and 425 are similar to the capacitor 224 of FIG. 2, wherein the capacitor 424 is coupled between the node 452 and the node 454, and the capacitor 425 is coupled between the node 453 and the node 455. In one embodiment, the capacitors 424 and 425 have a capacitance of 8 pF. The resistors 426 and 427 are similar to the resistor 226 of FIG. 2, wherein the resistor 426 is coupled between the node 454 and the voltage source $V_G$, and the resistor 427 is coupled between the node 455 and the voltage source $V_G$. As the resistor 226 of FIG. 2, the resistors 426 and 425 have a large resistance greater than 1 MΩ to ensure that the cut-off frequencies of the biasing circuit 404 are higher than 20 Hz. In one embodiment, both the resistors 426 and 427 have a resistance of 1 GΩ. The resistors 426 and 427 can be implemented with the load element 320 of FIG. 3A or the load element 330 of FIG. 3B.

The invention provides a microphone circuit comprising a microphone and an integrated circuit. A biasing circuit for biasing the microphone is merged into the integrated circuit to reduce the size of the whole microphone circuit. A capacitor of the biasing circuit is designed to have a capacitance ranging between 1 fF and 100 pF, and a resistor of the biasing circuit is designed to have a resistance greater than 1 MΩ. Thus, the microphone circuit can meet size requirements of portable devices and can be installed in devices such as cell phones with limited size.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An integrated circuit, receiving a first signal and a first opposite signal from a microphone via a first node and a first opposite node, comprising:

a biasing circuit, coupled between the first node, the first opposite node, a second node, and a second opposite node, biasing the microphone with a first voltage source and a second voltage source, filtering the first signal to generate a second signal at the second node, filtering the first opposite signal to generate a second opposite signal at the second opposite node, and comprising:

a first resistor, coupled between the first voltage source and the first node;

a first capacitor, coupled between the first node and the second node;

a first load element, coupled between the second node and a third voltage source;

a second resistor, coupled between the first opposite voltage source and the first opposite node;

a second capacitor, coupled between the first opposite node and the second opposite node; and a second load element, coupled between the second opposite node and the third voltage source; and a buffering circuit, coupled between the second node, the second opposite node, a third node, and a third opposite node, buffering the second signal to generate a third signal at the third node, and buffering the second opposite signal to generate a third opposite signal at the third opposite node;

wherein the buffering circuit comprises:

a first amplifier, having an positive input terminal coupled to the second node, a negative input terminal coupled to the third node, and an output terminal coupled to the third node; and a second amplifier, having an positive input terminal coupled to the second opposite node, a negative input terminal coupled to the third opposite node, and an output terminal coupled to the third opposite node.

2. The integrated circuit as claimed in claim 1, wherein both the first load element and the second load element have a resistance larger than 1 MΩ.

3. The integrated circuit as claimed in claim 1, wherein the first load element comprises:

a first diode, coupled between the second node and the third voltage source; and a second diode, coupled between the second node and the third voltage source in a direction inverse to that of the first diode;

wherein a voltage difference across the first load element is less than 0.3V to turn off both the first diode and the second diode; and the second load element comprises:

a third diode, coupled between the second opposite node and the third voltage source; and a fourth diode, coupled between the second node and the third voltage source in a direction inverse to that of the third diode;

wherein a voltage difference across the second load element is less than 0.3V to turn off both the third diode and the fourth diode.

4. The integrated circuit as claimed in claim 1, wherein the first load element comprises a first transistor, having a drain coupled to the second node, a source coupled to the third voltage source, and a gate coupled to a fourth voltage source, and the second load element comprises a second transistor, having a drain coupled to the second opposite node, a source coupled to the third voltage source, and a gate coupled to a fifth voltage source, wherein a difference between the voltages of the third voltage source and the fourth voltage source is less than a threshold voltage of the first transistor by 0.7V to bias the first transistor in a weak inversion region, and a difference between the voltages of the third voltage source and the fifth voltage source is less than a threshold voltage of the second transistor by 0.7V to bias the second transistor in a weak inversion region.

5. The integrated circuit as claimed in claim 1, wherein the biasing circuit filters the first signal with a cut-off frequency at an approximation of 20 Hz to generate the second signal, and the biasing circuit filters the first opposite signal with a cut-off frequency at an approximation of 20 Hz to generate the second opposite signal.

6. The integrated circuit as claimed in claim 1, wherein the integrated circuit further comprises an analog-to-digital converter, coupled to the buffering circuit via the third node and the third opposite node, converting a difference signal between the third signal and the third opposite signal from analog to digital.

7. The integrated circuit as claimed in claim 1, wherein the microphone is an electret condenser microphone (ECM).

8. The integrated circuit as claimed in claim 7, wherein the microphone comprises:

a transducer, converting a sound pressure to a voltage signal;

a second capacitor, coupled between the transducer and a gate of a transistor; and the transistor, coupled between the first node and a ground, converting the voltage signal to generate the first signal at the first node.

* * * * *